United States Patent [19]

Leibrock

[11] 4,123,216

[45] Oct. 31, 1978

[54] COAL COMPACTING APPARATUS

[75] Inventor: Kurt Leibrock, Fürstenhausen, Fed. Rep. of Germany

[73] Assignee: Saarbergwerke Aktiengesellschaft, Saarbrucken, Fed. Rep. of Germany

[21] Appl. No.: 762,420

[22] Filed: Jan. 25, 1977

[30] Foreign Application Priority Data

Jan. 31, 1976 [DE] Fed. Rep. of Germany ..... 2603677

[51] Int. Cl.[2] ..... B28B 1/04

[52] U.S. Cl. ..... 425/431; 425/456; 425/469

[58] Field of Search ..... 425/424, 428, 431, 456, 425/469; 100/265; 24/DIG. 13, DIG. 26, 263 DA, 248, 249

[56] References Cited

U.S. PATENT DOCUMENTS

| | | | |
|---|---|---|---|
| 915,331 | 3/1909 | Bongardt | 425/456 |
| 921,287 | 5/1909 | Schmidt | 425/428 |
| 1,529,930 | 3/1925 | Sharp | 24/249 DP |
| 2,275,398 | 3/1942 | Koppers | 425/258 |

FOREIGN PATENT DOCUMENTS

| | | | |
|---|---|---|---|
| 482,390 | 3/1916 | France | 425/431 |
| 41,156 | 7/1914 | Sweden | 425/431 |
| 145,103 | 2/1931 | Switzerland | 24/249 PP |

*Primary Examiner*—Francis S. Husar
*Assistant Examiner*—John McQuade
*Attorney, Agent, or Firm*—Michael J. Striker

[57] ABSTRACT

Coal is pounded in a pounding box to form it into a cake which is then introduced into a coke oven. The pounding is effected by members that are repeatedly lifted and then allowed to drop onto the coal in the pounding box. When the coal is thus formed into a cake, the members are retained in lifted condition by a locking-cam mechanism so that the cake can be pushed from beneath the members.

11 Claims, 4 Drawing Figures

COAL COMPACTING APPARATUS

BACKGROUND OF THE INVENTION

This invention relates to the pounding equipment of a coke oven plant using coal compacted by punners. In particular, it relates to a mechanism for retaining such punners in raised position.

Certain coke oven plants make use of a coking coal that is first compacted. This compacting is effected by pounding the coal in a pounding box with pounding members known as punners until it resembles a cake which is then pushed into an oven chamber for coking. The transference of the cake into the oven chamber after the coal has been compacted by pounding requires that the punners of the pounding box be retained in raised position after they have been lifted out of the pounding box, and are not lowered again until the pounding box is ready for the next compaction cycle.

The retention of the punners in raised position at the end of a compaction cycle was heretofore effected by manually driving a wedge against each of the punner rods. This took a good deal of time, particularly when the pounding box was associated with a large number of punners. Moreover, such wedges are likely to loosen during the period for which the punners should be kept raised, since the manual driving of a wedge is not a strictly controlled operation and its results are sometimes unsatisfactory due to human failings. On the other hand, driving wedges by hand also often leads to the punner rods being damaged in the region where the wedges are set. The result is an undesirable loss of time due to the need to effect repairs and the inactivation of the pounding box for considerable periods.

SUMMARY OF THE INVENTION

It is therefore an object of the invention to overcome this disadvantage.

More particularly, it is an object of the invention to provide a retaining mechanism which permits the individual punners to be locked in raised position, without the need for manual intervention, in a manner that substantially reduces the risk of damage to the punners.

In pursuance of these objects, and of others which will become apparent hereafter, the present invention provides a mechanism for retaining the punners in raised position in the pounding equipment of a coke oven plant using coal compacted by punners which each has a foot attached to a rod, the punners being repeatedly lifted and then dropped with their feet onto the surface of the coal and thus pounding the same in a pounding box, said mechanism comprising two pivoted locking cams associated with each punner on opposite sides of its rod and adapted to be mechanically swung into gripping engagement with the rod.

It is currently preferred that the punner rod should be an H-section bar of which the web is engaged from either side by one of the locking cams.

In a particularly advantageous embodiment the gripping contact surface of each cam is eccentrically curved in relation to the cam pivot.

This form of construction of the retaining mechanism permits the punners to be safely gripped and retained without requiring any manual work, and at the same time it subjects the punners and their rods to the minimum possible risk of being damaged.

The novel mechanism may conveniently be so designed that the two locking cams associated with each punner are operable by a common actuating means which applies and withdraws them simultaneously to and from the sides of the punner rod.

Preferably the application and withdrawal of the locking cams to and from the punner rods is effected by coupling the locking cams on opposite sides via meshing gear means. Thus, all the locking cams which engage the same side of a plurality of punner rods may be fixed on a common shaft to which a gear segment is also affixed which meshes with the teeth of a like gear segment of a corresponding shaft on the other side. This construction of the retaining mechanism will reliably and positively ensure that all the locking cams on both sides of the punner rods will respectively drop into engagement with and release the punner rods simultaneously.

It is sufficient if the arcuate working surface of each cam subtends an angle of less than 90° at the cam fulcrum. If the locking cams are mounted on their shaft with angular lost motion, then this has the advantage that the cams will grip the associated punner rod by dropping into engagement therewith. This gives a better grip without the need for the special application of external forces.

It is also desirable to mount the two shafts in parallel and to associate one of them with a turning drive comprising an actuator. The rotation of one shaft by the turning drive will then automatically cause both shafts to turn and the locking cams to move jointly into and out of engagement with the respective punner rods.

The actuator may be a hydraulic actuator. It is currently preferred to provide each punner rod with a friction lining in the region where it is engaged by the locking cams. This reduces wear by abrasion both on the punner rods and on the cams themselves.

The novel features which are considered as characteristic for the invention are set forth in particular in the appended claims. The invention itself, however, both as to its construction and its operation, together with additional objects and advantages thereof, will be best understood from the following description of specific embodiments when read in connection with the accompanying drawings.

DESCRIPTION OF A PREFERRED EMBODIMENT

Figure 1:
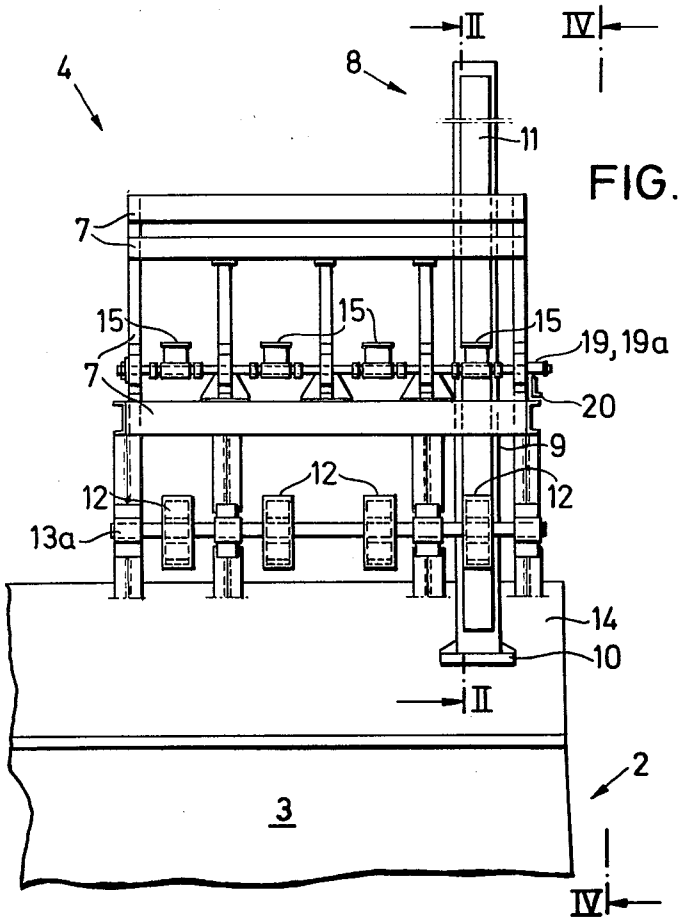
FIG. 1 is a side elevation of pounding equipment and of an associated pounding box for compacting the coal, according to the invention.
Figure 4:
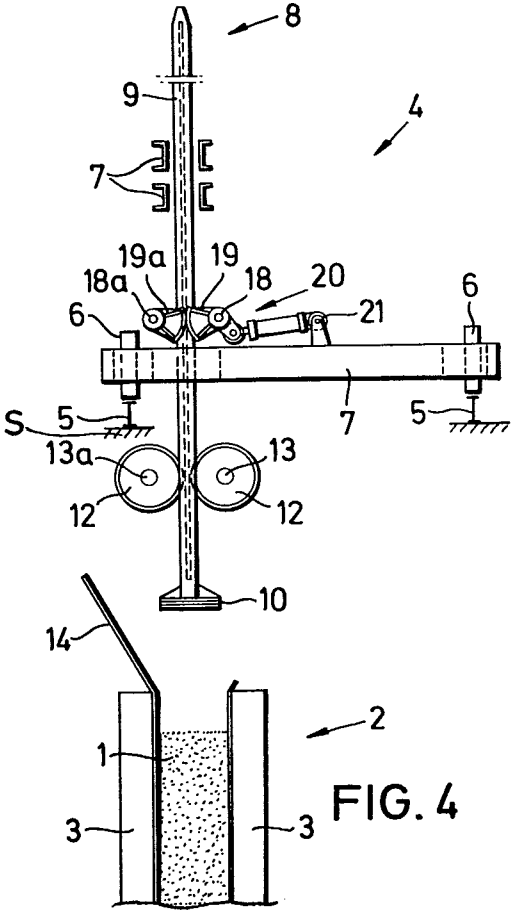
FIG. 4 is a front elevation as seen from the line IV—IV in FIG. 1, of the pounding equipment and the pounding box of FIG. 1.

FIG. 1 shows pounding equipment mounted on a supporting structure S(FIG. 4) above a pounding box 2 which has side walls 3 and in which a charge of coking coal is to be compacted (see also FIG. 4). The equipment comprises one or more punner carriages 4 fitted with wheels 6 (FIG. 4) permitting the carriages to move lengthwise of the box 2 on a rail track 5 fixed to the supporting structure S.

The punner carriages 4 may be constructed of steel U and/or H sections 7 and are each designed to carry four punners 8. Each punner 8 has a steel H-section punner rod 9 and a punner foot 10. Only one of the punners 8 is shown in FIG. 1. The punner carriages 4 may of course also be designed to carry six or more punners 8 each.

Figure 2:
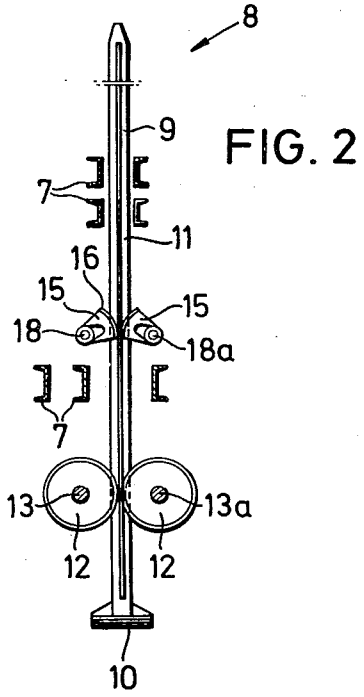
FIG. 2 is a vertical section, taken on line II—II of FIG. 1 and showing one of the punners in FIG. 1.

To compact the coking coal 1 in the pounding box 2 the feet 10 of the punners 8 are lowered into contact with the open surface of the coal 1 and then raised again in timed succession while the punner carriage 4 is moved to and fro, i.e., normal to the plane of FIG. 4. The lowering of the punners 8 consists in allowing them to drop in free fall, i.e., to descend by gravity. For the purpose of lifting the punners 8 a pair of eccentrically mounted revolving lifting discs 12 is associated with each punner 8 for yieldingly engaging the web 11 of the punner rod 9 at the same level from opposite sides. All of the lifting discs 12 enagaging the punners 8 on a punner carriage from the same side are fixed to a common shaft 13 (FIG. 2) or 13*a* at angles which consecutively differ by 90°. The discs thus release and allow the punners to drop consecutively in a timed working cycle. During the process of compaction of the coal more coking coal is continuously fed down an apron 14 (FIG. 4) into the path of the punner feet evenly along the length of the pounding box 2, the apron 14 itself being supplied from a coal hopper not shown in the drawings.

Figure 3:
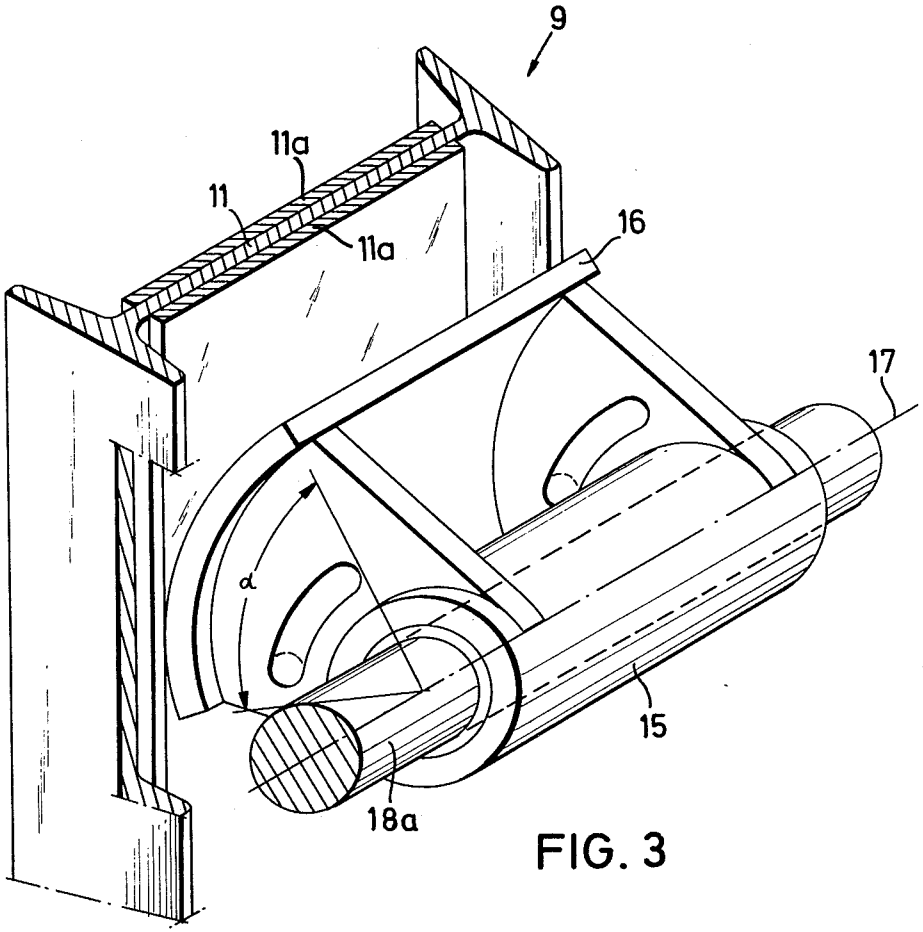
FIG. 3 is a perspective view, on an enlarged scale, of a retaining mechanism for a punner according to FIG. 1.

When the coal has been compacted into a cake by having been sufficiently pounded the punners 8 are retained in raised position until the next compacting cycle begins, so that the cake may be fed towards the coking oven. For this purpose each punner 8 is associated on opposite sides of its punner rod with a pair of opposed locking cams 15 which can be swung into engagement with the opposite sides of the web 11 to grip the same between them. The degree of swing is limited by the illustrated arcuate slots (FIG. 3) and pins extending into the same. The contact surface 16 of each cam 15 forms an eccentric curve with reference to the pivot 17 of the respective cam, as shown in FIG. 3. Moreover, the contact surface 16 of each cam 15 subtends an angle $\alpha$ of about 50° at the pivot 17 of the cam, as also shown in FIG. 3.

All of the locking cams 15 which can be deflected into contact with the punners 8 on one side of the punner carriage 4 are mounted with angular lost motion on a shaft 18. All of the locking cams which can be deflected into contact with the punners 8 on the other side of carriage 4 are mounted with angular lost motion on a shaft 18*a*. Gear segments 19 and 19*a* are keyed to one end of each of the two parallel shafts 18, 18*a* and the teeth of the two segments 19, 19*a* mesh with each other. Shaft 18 is associated with a drive 20 which is operated by a hydraulic actuator cylinder 21 and transmits rotary motion to the shaft 18.

In the region where each punner rod 9 is gripped by the locking cams 15 the webs 11 of the rods 9 are provided with a friction lining 11*a* which reduces wear of the webs and of the contact surfaces 16 of the locking cams 15. Such friction lining 11*a* may be of a suitable metallic or elastomeric material. Such a material may be heat-resisting asbestos, for instance.

When at the end of a compacting cycle the punners 8 are to be retained in raised position the piston of the hydraulic actuator cylinder 21 is retracted. This causes the gear segments 19 and 19*a* on shafts 18, 18*a* to be turned downwards (i.e., counterclockwise) towards the pounding box 2 (FIG. 4). At the same time the locking cams 15 on shafts 18, 18*a* turn until they drop (due to their mounting with angular lost motion) into engagement with the sides of the webs 11 of the punner rods 9, thus gripping the webs 11 between them and preventing the punners 8 from descending under the influence of gravity. When the next compaction cycle is to begin the piston rod of the hydraulic actuator cylinder 21 is extended and turns the gear segments 19 and 19*a* back again in the opposite (i.e., clockwise) direction so that the locking cams 15 are raised and release the punner rods 9. The punners 8 are therefore again free to drop down on the next charge of coking coal 1 in the pounding box 2 and to pound it with their feet 10.

It will be understood that each of the elements described above, or two or more together, may also find a useful application in other types of devices differing from the types described above.

While the invention has been illustrated and described as embodied in the pounding of coal for coke ovens, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. In an apparatus for compacting coal into a cake for use in coke ovens, a combination comprising a pounding box for receiving coal to be compacted; a plurality of punners each having a foot and a rod formed with a web and projecting upwardly from the foot; means mounting said punners above said pounding box for repeated lifting relative to the pounding box and dropping onto the coal in the same; a mechanism for retaining the punners in raised position upon completion of the compacting operation, said mechanism comprising a pair of pivoted locking cams mounted at opposite sides of each of said punner rods, and each cam of a respective pair being mounted for swinging movement about a pivot and having an arcuate gripping contact surface which subtends an angle smaller than 90° at the associated pivot, and said cams being mounted on respective shafts with freedom of limited angular lost motion relative thereto; and means operatively connected with said cams for mechanically swinging the cams of each pair into gripping engagement with the opposite sides of said web of the associated rod for retaining the same in the raised position thereof.

2. An apparatus as defined in claim 1; further comprising two parallel shafts extending along opposite sides of said punner rods, all of the cams for one of said sides being mounted on one of said shafts and all of the cams for the other of said sides being mounted on the other of said shafts; drive means connected with and operative for turning one of said shafts; and motion-transmitting means operatively connected with said shafts for transmitting the turning motion of said one shaft to the other of said shafts.

3. An apparatus as defined in claim 1, wherein each gripping contact surface is eccentrically arcuate relative to the pivot of the cam.

4. An apparatus as defined in claim 1, wherein each punner rod is a bar of H-shaped cross-section which includes two flanges connected by said web.

5. An apparatus as defined in claim 1; and further comprising actuating means, including meshing gear means operatively connected with said swinging means, for applying and withdrawing both cams of each pair simultaneously to and from the sides of the respectively associated rod.

6. An apparatus as defined in claim 5, said actuating means comprising two shafts extending along opposite sides of said punner rods, all of the locking cams for one of said sides being mounted on one of said shafts and all of the locking cams for the other of said sides being mounted on the other of said shafts.

7. An apparatus in claim 6, wherein said gear means comprises a pair of gear segments each being mounted on one of said shafts and meshing with the other gear segment.

8. An apparatus as defined in claim 1; and drive means comprising an actuator linked to one shaft.

9. An apparatus as defined in claim 8, wherein said actuator is a hydraulic actuator.

10. An apparatus as defined in claim 1; and further comprising a friction-promoting lining on the respective rods at least in the region where said rods are engageable by said locking cams.

11. An apparatus as defined in claim 1; and further comprising actuating means operatively connected with said swinging means for applying and withdrawing both cams of each pair simultaneously to and from the opposite sides of said web of the respectively associated rod.

* * * * *